US009915404B1

(12) United States Patent
Sun et al.

(10) Patent No.: US 9,915,404 B1
(45) Date of Patent: Mar. 13, 2018

(54) OPTICAL ELEMENT AND CAR LAMP

(71) Applicant: BROALUX International Limited, Tortola (VG)

(72) Inventors: Jui-Hung Sun, Taipei (TW); Chun-Te Wu, Taipei (TW)

(73) Assignee: BROALUX International Limited, Tortola (VG)

( * ) Notice: Subject to any disclaimer, the term of this patent is extended or adjusted under 35 U.S.C. 154(b) by 0 days.

(21) Appl. No.: 15/264,612

(22) Filed: Sep. 14, 2016

(51) Int. Cl.
*F21S 8/10* (2006.01)

(52) U.S. Cl.
CPC ..... *F21S 48/1225* (2013.01); *F21S 48/115* (2013.01); *F21S 48/1317* (2013.01)

(58) Field of Classification Search
CPC .. F21S 48/1225; F21S 48/1317; F21S 48/137; F21S 48/115; F21S 48/1154
See application file for complete search history.

(56) References Cited

U.S. PATENT DOCUMENTS

2007/0064431 A1* 3/2007 Fallahi ..... F21S 48/2212 362/334
2014/0085919 A1* 3/2014 Tsai ..... F21S 48/137 362/522

* cited by examiner

*Primary Examiner* — Karabi Guharay
(74) *Attorney, Agent, or Firm* — JCIPRNET

(57) ABSTRACT

An optical element includes a light entrance surface, a light exit surface, and a reflective surface. The light entrance surface has a first entrance sub-surface, a second entrance sub-surface, and a third entrance sub-surface which form a cavity for containing a light source. The light exit surface is opposite to the light entrance surface and has a first exit sub-surface, a second exit sub-surface, and a third exit sub-surface. The reflective surface connects the light entrance surface with the light exit surface. The reflective surface has a first reflective sub-surface connecting the first entrance sub-surface with the first exit sub-surface and a second reflective sub-surface connecting the third entrance sub-surface with the third exit sub-surface. The first reflective sub-surface has a step laterally extending from a side adjacent to the light entrance surface to another side adjacent to the light exit surface.

15 Claims, 6 Drawing Sheets

OPTICAL ELEMENT AND CAR LAMP

BACKGROUND OF THE INVENTION

1. Field of the Invention

The invention relates to an optical element and a car lamp.

2. Description of Related Art

With the improvement of light source technology, new generation light sources, e.g. light-emitting diodes (LEDs), have been adopted in automobile headlights. LED headlights have been gradually applied in compliance with requirements for light-emitting efficiency, energy saving, and environmental protection. Especially, more and more high-end automobiles adopt LED headlights.

However, the optical property of LEDs is different from that of conventional halogen bulbs or xenon lamps. Light emitted by LED chips usually has high directivity. When an LED is combined with the optical elements of a conventional headlight module, the volume of the headlight module is large, and the optical alignment between the LED and the optical elements is complicated. Moreover, the reflective material of a conventional optical element may absorb some light, and a shielding element configured to form a cut-off line may block some light, so that the light efficiency of the headlight module is reduced.

In addition, the precision of the alignment of a halogen bulb or a xenon lamp in a conventional headlight module is not needed to be high. As a result, if an LED is used to replace the halogen bulb or the xenon lamp in the conventional headlight module to form a new leadlight module, the light efficiency of the new headlight module is not satisfied.

SUMMARY OF THE INVENTION

Accordingly, the invention is directed to an optical element, which has high light use efficiency.

The invention is directed to a car lamp, which has high light efficiency.

An embodiment of the invention provides an optical element including a light entrance surface, a light exit surface, and a reflective surface. The light entrance surface has a first entrance sub-surface, a second entrance sub-surface, and a third entrance sub-surface which form a cavity for containing a light source, wherein the second entrance sub-surface connects the first entrance sub-surface with the third entrance sub-surface. The light exit surface is opposite to the light entrance surface and has a first exit sub-surface, a second exit sub-surface, and a third exit sub-surface, wherein the second exit sub-surface is connected between the first exit sub-surface and the third exit sub-surface. The reflective surface connects the light entrance surface with the light exit surface. The reflective surface has a first reflective sub-surface connecting the first entrance sub-surface with the first exit sub-surface and a second reflective sub-surface connecting the third entrance sub-surface with the third exit sub-surface, wherein the first reflective sub-surface has a step laterally extending from a side adjacent to the light entrance surface to another side adjacent to the light exit surface. A first portion of light from the light source passes through the first entrance sub-surface, is reflected by the first reflective sub-surface, passes through the first exit sub-surface, and is projected onto a reference plane 25 meters away from the optical element in sequence so as to form a cut-off line on the reference plane. The cut-off line is a boundary between a bright area and a dark area, and light from the step forms an inclined portion of the cut-off line. A second portion of light from the light source passes through the second entrance sub-surface and the second exit sub-surface in sequence and is projected onto the bright area. A third portion of light from the light source passes through the third entrance sub-surface, is reflected by the second reflective sub-surface, passes through the third exit sub-surface, and is projected onto the bright area in sequence.

An embodiment of the invention provides a car lamp including a light source, a lens, and the aforementioned optical element. The light source is capable of emitting light. The lens is disposed on the path of the light from the light source. The optical element is disposed on the path of the light from the light source and between the light source and the lens. A first portion of the light from the light source passes through the first entrance sub-surface, is reflected by the first reflective sub-surface, passes through the first exit sub-surface, and is projected onto a reference plane 25 meters away from the optical element by the lens in sequence so as to form a cut-off line on the reference plane. A second portion of the light from the light source passes through the second entrance sub-surface and the second exit sub-surface in sequence and is projected onto the bright area by the lens. A third portion of the light from the light source passes through the third entrance sub-surface, is reflected by the second reflective sub-surface, passes through the third exit sub-surface, and is projected onto the bright area by the lens in sequence.

In the optical element and the car lamp according to the embodiment of the invention, the first reflective sub-surface has a step laterally extending from a side adjacent to the light entrance surface to another side adjacent to the light exit surface, so as to form an inclined portion of the cut-off line. As a result, the optical element and the car lamp may comply with regulations related to a car lamp, e.g. ECE R112 code in Regulations of United Nations Economic Commission for Europe (ECE regulations), without using a light shielding element. Therefore, the optical element and the car lamp according to the embodiment of the invention has high light efficiency.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
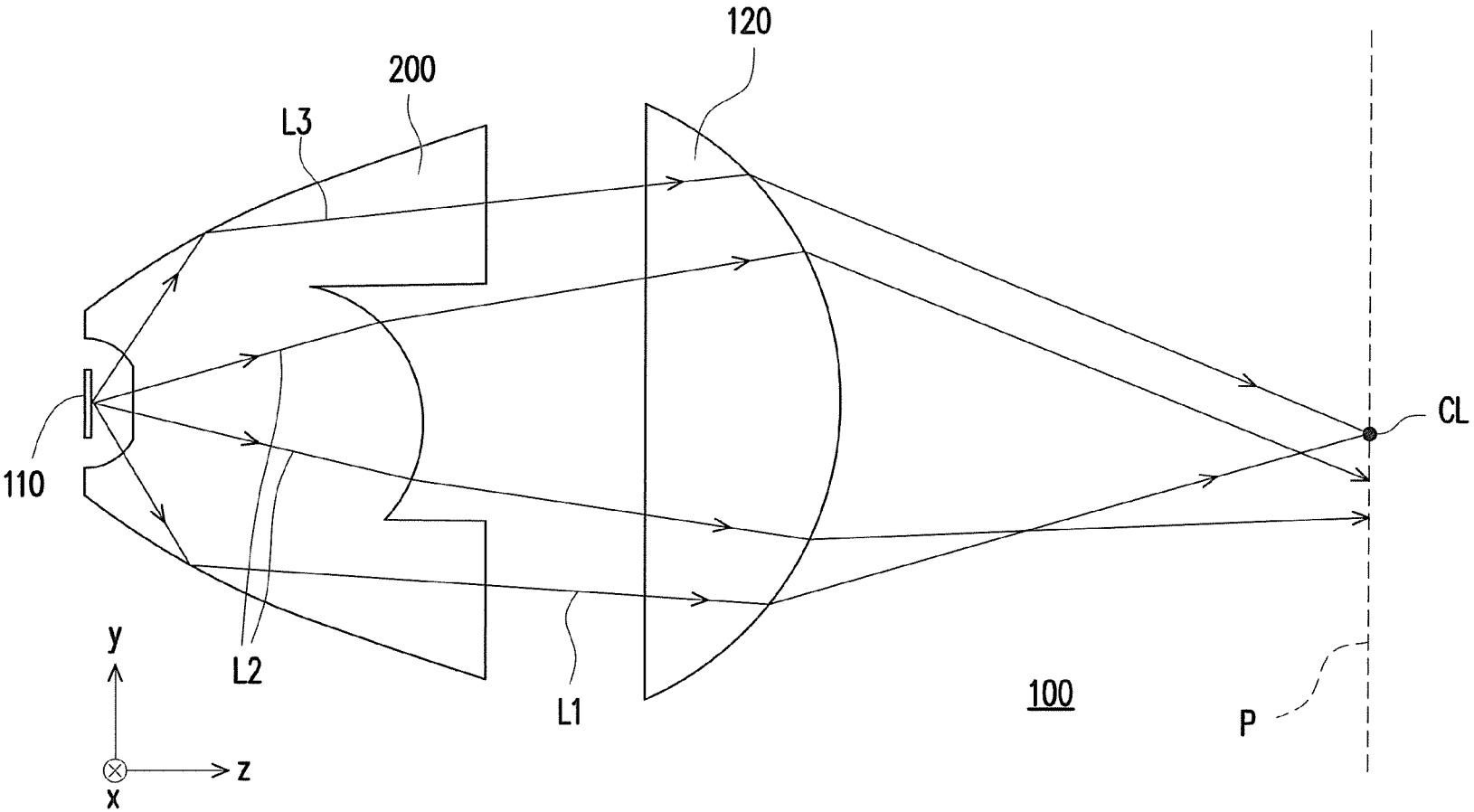
FIG. 1 is a schematic cross-sectional view of a car lamp according to an embodiment of the invention.

Reference will now be made in detail to the present embodiments of the invention, examples of which are illustrated in the accompanying drawings. Wherever possible, the same reference numbers are used in the drawings and the description to refer to the same or like parts.

Figure 2:
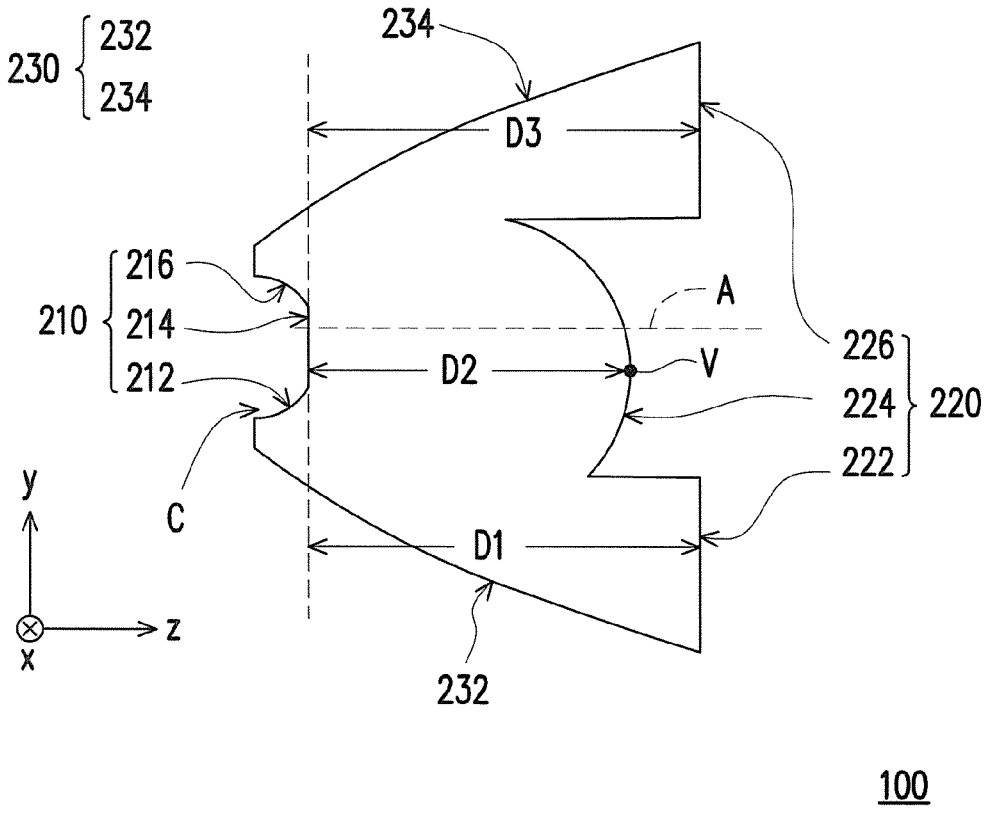
FIG. 2 is a schematic cross-sectional view of the optical element n FIG. 1.
Figure 3:
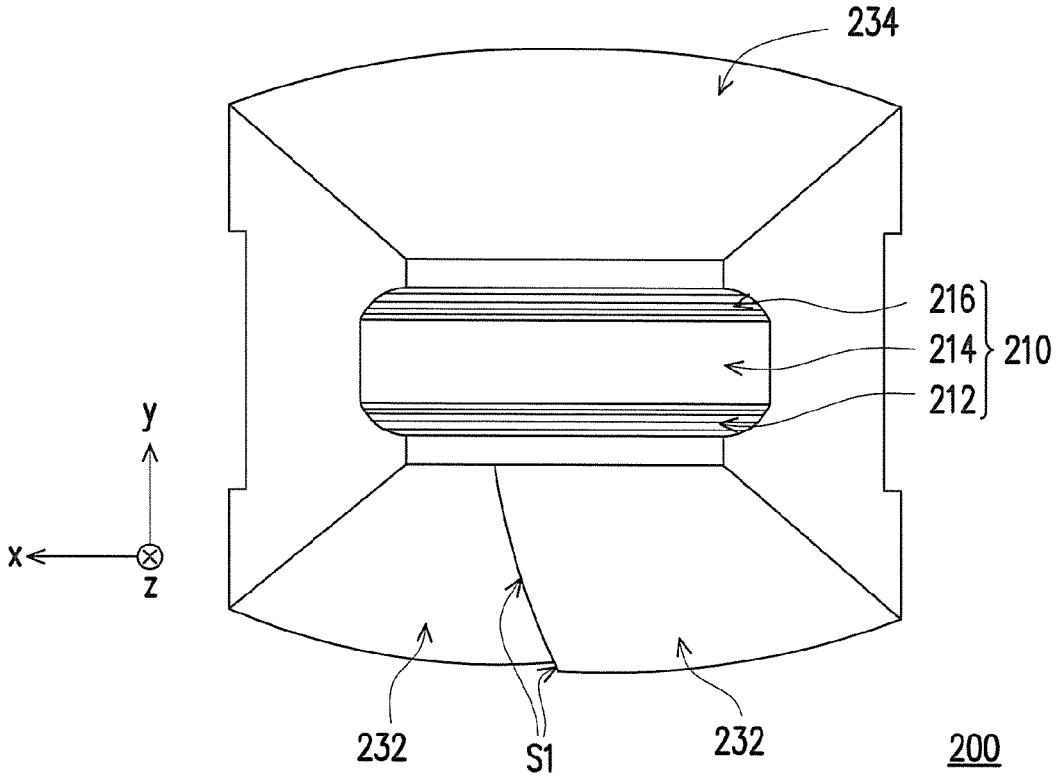
FIG. 3 is a schematic back view of the optical element in FIG. 1.
Figure 4:
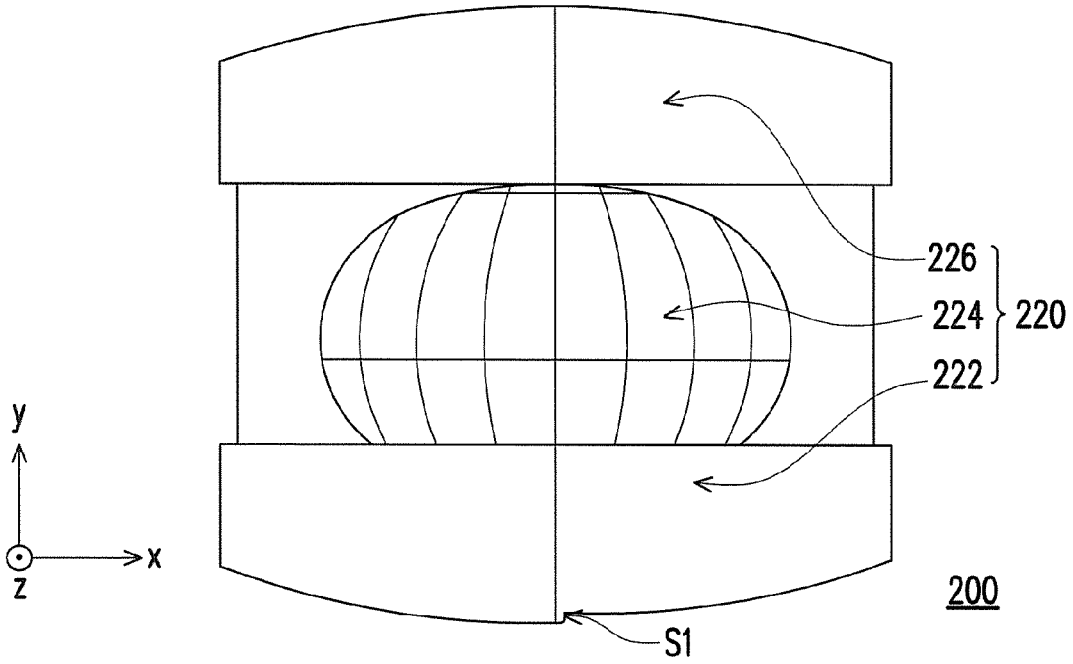
FIG. 4 is a schematic front view of the optical element in FIG. 1.
Figure 5:
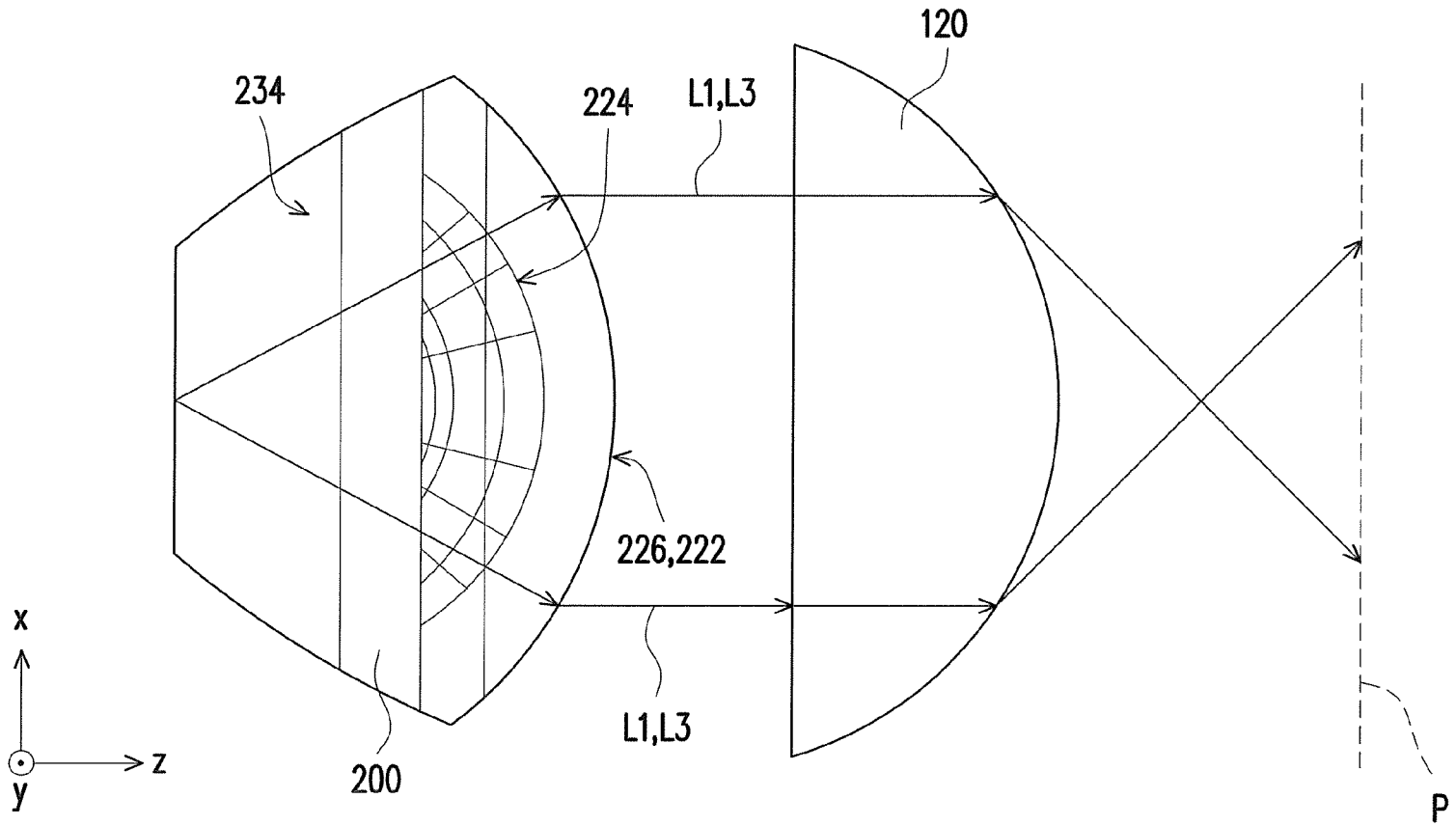
FIG. 5 is a schematic top view of the car lamp in FIG. 1.

FIG. 1 is a schematic cross-sectional view of a car lamp according to an embodiment of the invention, FIG. 2 is a schematic cross-sectional view of the optical element in FIG. 1, FIG. 3 is a schematic back view of the optical element in FIG. 1, FIG. 4 is a schematic front view of the optical element in FIG. 1, and FIG. 5 is a schematic top view of the car lamp in FIG. 1. Referring to FIG. 1 to FIG. 5, the car lamp 100 in this embodiment includes a light source 110, a lens 120, and an optical element 200. The space occupied by the light source 110, the lens 120, and the optical element 200 may be defined by a Cartesian coordinate system having an x-direction, a y-direction, and a z-direction perpendicular to each other. The light source 110 is capable of emitting light. In this embodiment, the light source 110 includes at least one light-emitting diode (LED). For example, the light source 110 may include a plurality of LEDs arranged along the x-direction.

The lens 120 is disposed on the path of the light from the light source 110. The lens 120 may be a convex lens, e.g. a plane-convex lens, a biconvex lens, or a concave-convex lens. The optical element 200 is disposed on the path of the light from the light source 110 and between the light source 110 and the lens 120. The optical element 200 includes a light entrance surface 210, a light exit surface 220, and a reflective surface 230. In this embodiment, the optical element 200 is made of a transparent material. The light entrance surface 210 has a first entrance sub-surface 212, a second entrance sub-surface 214, and a third entrance sub-surface 216 which form a cavity C for containing the light source 110, wherein the second entrance sub-surface 214 connects the first entrance sub-surface 212 with the third entrance sub-surface 216. In this embodiment, the first entrance sub-surface 212, the second entrance sub-surface 214, and the third entrance sub-surface 216 are arranged in the y-direction.

The light exit surface 220 is opposite to the light entrance surface 210 and has a first exit sub-surface 222, a second exit sub-surface 224, and a third exit sub-surface 226, wherein the second exit sub-surface 224 is connected between the first exit sub-surface 222 and the third exit sub-surface 226. The reflective surface 230 connects the light entrance surface 210 with the light exit surface 220. The reflective surface 230 has a first reflective sub-surface 232 connecting the first entrance sub-surface 212 with the first exit sub-surface 222 and a second reflective sub-surface 234 connecting the third entrance sub-surface 216 with the third exit sub-surface 226, wherein the first reflective sub-surface 232 has a step S1 laterally extending from a side adjacent to the light entrance surface 210 to another side adjacent to the light exit surface 220. In this embodiment, the first reflective sub-surface 232 and the second reflective sub-surface 234 are arranged along the y-direction.

Figure 6:
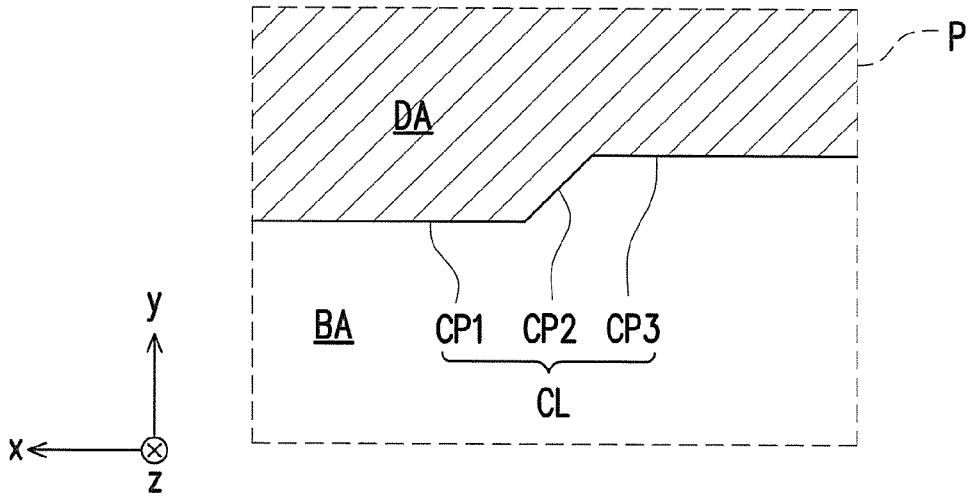
FIG. 6 is a schematic diagram showing the light distribution on the reference plane 25 meters away from the optical element in FIG. 1.

A first portion L1 of light from the light source 110 passes through the first entrance sub-surface 212, is reflected by the first reflective sub-surface 232, passes through the first exit sub-surface 222, and is projected by the lens 120 onto a reference plane P 25 meters away from the optical element 200 in sequence so as to form a cut-off line CL on the reference plane P. The cut-off line CL is a boundary between a bright area BA and a dark area DA, and light from the step S1 forms an inclined portion CP2 of the cut-off line CL. The cut-off line CL may comply with regulations related to a car lamp, e.g. ECE R112 code in Regulations of United Nations Economic Commission for Europe (ECE regulations), and the car lamp 100 may be an automobile head lamp, e.g. a low-beam headlight. The cut-off line CL shown in FIG. 6 is suitable for right-hand traffic, and the side surface of the step S1 approximately faces the +x-direction. However, for left-hand traffic, the side surface of the step S1 may approximately face the −x-direction. A screen may be disposed on the reference plane P, so that the light distribution on the reference plane P may be measured.

In this embodiment, the first portion L1 from the first entrance sub-surface 212 is totally internally reflected by the first reflective sub-surface 232 to the first exit sub-surface 222. Moreover, in this embodiment, the first portion L1 is projected onto the bright area BA below the cut-off line CL including a horizontal portion CP1, the inclined portion CP2, and another horizontal portion CP3, wherein the inclined portion CP2 connects the horizontal portion CP1 with the horizontal portion CP3 and is inclined with respect to the horizontal portions CP1 and CP3 by 45 degrees. In this embodiment, the lateral extending direction of the step S1 is inclined with respect to the yz plane as shown in FIG. 3, so that the first portion L1 may foil a longer horizontal portion CP3. However, in another embodiment, the lateral extending direction of the step S1 may be substantially parallel to the yz plane.

A second portion L2 of light from the light source 110 passes through the second entrance sub-surface 214 and the second exit sub-surface 224 in sequence and is projected by the lens 120 onto the bright area BA. In this embodiment, the second portion L2 form a bright band which is within the bright area BA and is spaced away from the cut-off line CL.

A third portion L3 of light from the light source 110 passes through the third entrance sub-surface 216, is reflected by the second reflective sub-surface 234, passes through the third exit sub-surface 226, and is projected by the lens 120 onto the bright area BA in sequence. In this embodiment, the third portion L3 from the third entrance sub-surface 216 is totally internally reflected by the second reflective sub-surface 234 to the third exit sub-surface 226. In this embodiment, the third portion L3 forms a bright band on the bright area BA and below the horizontal portion CP1.

In an embodiment, the first entrance sub-surface 212, the second entrance sub-surface 214, and the third entrance sub-surface 216 are formed by conic curves or freeform curves. Specifically, the first entrance sub-surface 212, the second entrance sub-surface 214, and the third entrance sub-surface 216 may be curved in a plane parallel to the yz plane and straight (not curved) along the x-direction, and the aforementioned conic curves and freeform curves are on cross-sectional planes parallel to the yz plane. However, in another embodiment, the first entrance sub-surface 212, the second entrance sub-surface 214, and the third entrance sub-surface 216 may also be curved in a plane parallel to the xy plane and in a plane parallel to the xz plane. In this embodiment, the second entrance sub-surface 214 is a plane surface substantially parallel to the xy plane, and the first entrance sub-surface 212 and the third entrance sub-surface 216 are curved surfaces which are curved in a plane parallel to the yz plane and straight (not curved) along the x-direction.

In this embodiment, the first reflective sub-surface 232 and the second reflective sub-surface 234 are formed by conic curves or freeform curves. For example, the first reflective sub-surface 232 and the second reflective sub-surface 234 may be curved surfaces curved in a plane parallel to the yz plane.

The first exit sub-surface 222 and the third exit sub-surface 226 may be plane surfaces or curved surfaces, and the second exit sub-surface 224 is a plane surface or a curved surface. In this embodiment, the first exit sub-surface 222 and the third exit sub-surface 226 are curved surfaces, and the second exit sub-surface 224 is a curved surface. In this embodiment, the first exit sub-surface 222 and the third exit sub-surface 226 are curved in a plane parallel to the xz plane, and are straight along the y-direction. Moreover, in this embodiment, the second exit sub-surface 224 is curved in a plane parallel to the yz plane and curved in a plane parallel to the xz plane. However, in other embodiments, the second exit sub-surface 224 may be curved in a plane parallel to the yz plane and be straight (not curved) along the x-direction. Moreover, in this embodiment, a vertex V of the second exit sub-surface 224 is off-center from a central axis A of the optical element 200. The central axis A may be parallel to the z-direction.

In this embodiment, a distance D2 parallel to the central axis A of the optical element 200 from the vertex V of the second exit sub-surface 224 to the second entrance sub-surface 214 is shorter than a distance D1 parallel to the central axis A from the first exit sub-surface 222 to the second entrance sub-surface 214, and is shorter than a distance D3 parallel to the central axis A from the third exit sub-surface 226 to the second entrance sub-surface 214.

In the optical element 200 and the car lamp 100 in this embodiment, the first reflective sub-surface 232 has a step laterally extending from a side adjacent to the light entrance surface 210 to another side adjacent to the light exit surface 220, so as to form the inclined portion CP2 of the cut-off line CL. As a result, the optical element 200 and the car lamp 100 may comply with regulations related to a car lamp, e.g. ECE R112 code in Regulations of United Nations Economic Commission for Europe (ECE regulations), without using a light shielding element. Therefore, the optical element 200 and the car lamp 100 in this embodiment has high light efficiency. In this embodiment, the first reflective sub-surface 232 has only one step S1, and the step S1 is configured to form the inclined portion CP2 of the cut-off line CL, so that the optical element 200 and the car lamp 100 may comply with the regulations related to a car lamp by adopting a simple structure. Therefore, the volume of the optical element 200 and the car lamp 100 is small, and the cost of the optical element 200 and the car lamp 100 is effectively reduced.

Figure 7:
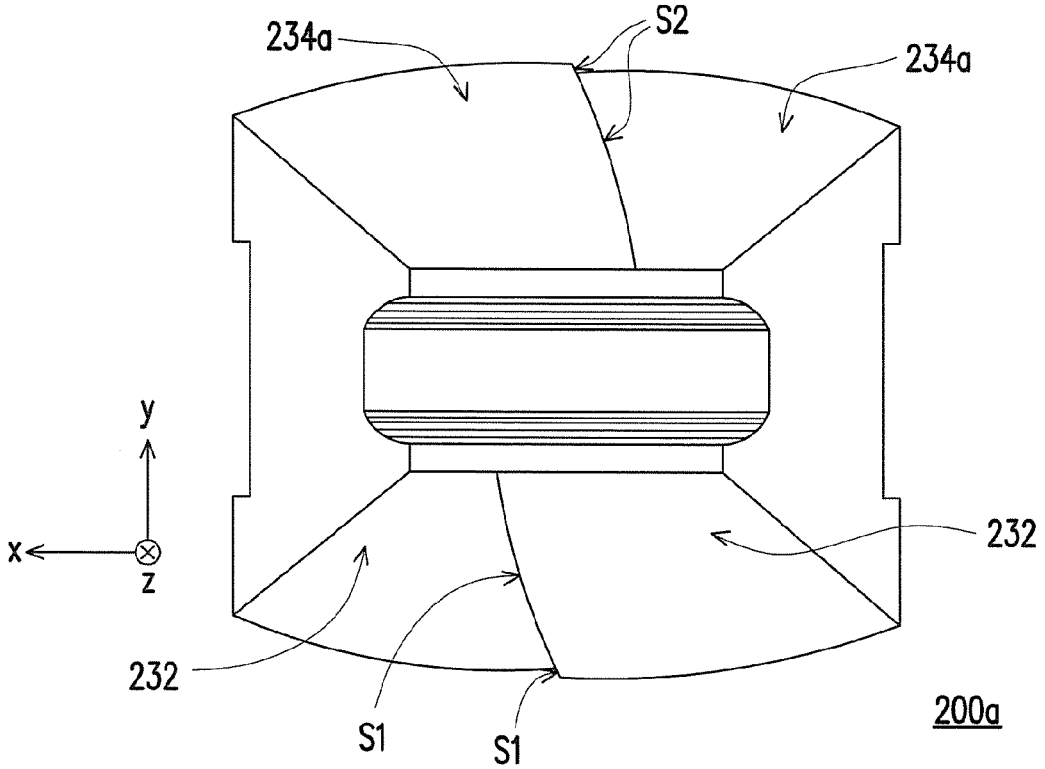
FIG. 7 is a schematic back view of an optical element according to another embodiment of the invention.
Figure 8:
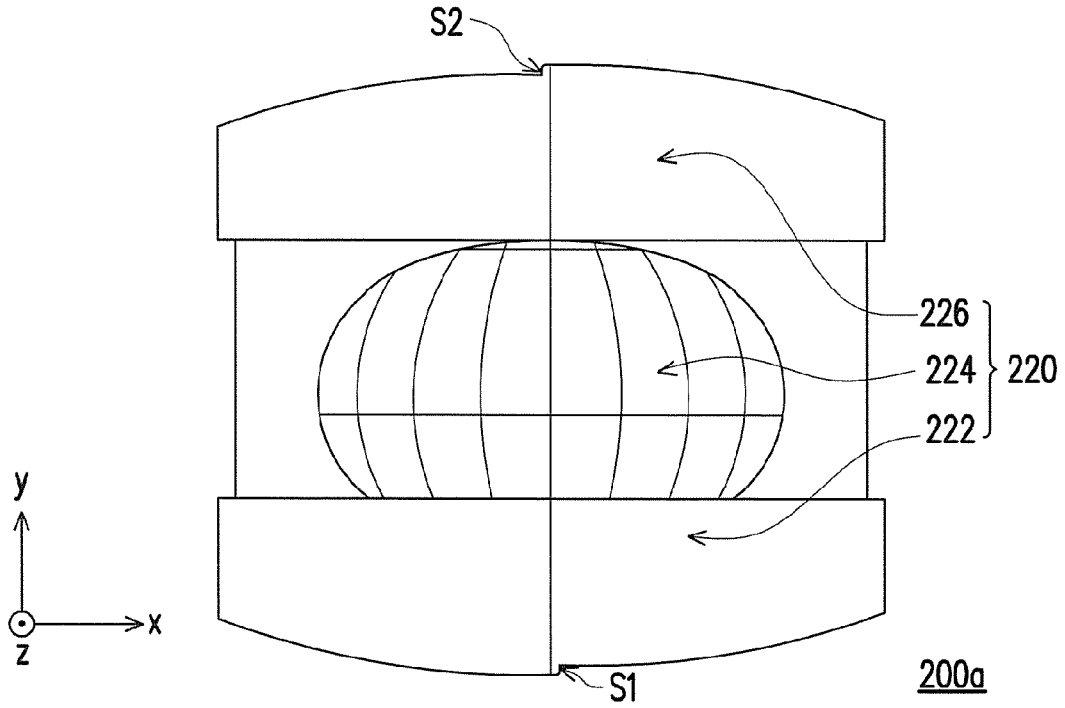
FIG. 8 is a schematic front view of the optical element in FIG. 7.

FIG. 7 is a schematic back view of an optical element according to another embodiment of the invention, and FIG. 8 is a schematic front view of the optical element in FIG. 7. Referring to FIG. 7 and FIG. 8, the optical element 200*a* in this embodiment is similar to the optical element 200 in FIG. 1, and the main difference therebetween is as follows. In the optical element 200*a*, the second reflective sub-surface 234*a* also has a step S2 laterally extending from the side adjacent to the light entrance surface 210 to the side adjacent to the light exit surface 220, and light from the step S2 of the second reflective sub-surface 234*a* also forms the inclined portion CP2 of the cut-off line CL.

In conclusion, in the optical element and the car lamp according to the embodiment of the invention, the first reflective sub-surface has a step laterally extending from a side adjacent to the light entrance surface to another side adjacent to the light exit surface, so as to form an inclined portion of the cut-off line. As a result, the optical element and the car lamp may comply with regulations related to a car lamp, e.g. ECE R112 code in Regulations of United Nations Economic Commission for Europe (ECE regulations), without using a light shielding element. Therefore, the optical element and the car lamp according to the embodiment of the invention has high light efficiency.

It will be apparent to those skilled in the art that various modifications and variations can be made to the structure of the invention without departing from the scope or spirit of the invention. In view of the foregoing, it is intended that the invention covers modifications and variations of this invention provided they fall within the scope of the following claims and their equivalents.

What is claimed is:

1. An optical element comprising:

a light entrance surface having a first entrance sub-surface, a second entrance sub-surface, and a third entrance sub-surface which form a cavity for containing a light source, wherein the second entrance sub-surface connects the first entrance sub-surface with the third entrance sub-surface;

a light exit surface opposite to the light entrance surface and having a first exit sub-surface, a second exit sub-surface, and a third exit sub-surface, wherein the second exit sub-surface is connected between the first exit sub-surface and the third exit sub-surface, and wherein the second exit sub-surface is a curved surface and a vertex of the second exit sub-surface is off-center from a central axis of the optical element; and a reflective surface connecting the light entrance surface with the light exit surface, the reflective surface having a first reflective sub-surface connecting the first entrance sub-surface with the first exit sub-surface and a second reflective sub-surface connecting the third entrance sub-surface with the third exit sub-surface, wherein the first reflective sub-surface has a step laterally extending from a side adjacent to the light entrance surface to another side adjacent to the light exit surface;

wherein a first portion of light from the light source passes through the first entrance sub-surface, is reflected by the first reflective sub-surface, passes through the first exit sub-surface, and is projected onto a reference plane 25 meters away from the optical element in sequence so as to form a cut-off line on the reference plane, the cut-off line is a boundary between a bright area and a dark area, and light from the step forms an inclined portion of the cut-off line;

wherein a second portion of light from the light source passes through the second entrance sub-surface and the second exit sub-surface in sequence and is projected onto the bright area; and wherein a third portion of light from the light source passes through the third entrance sub-surface, is reflected by the second reflective sub-surface, passes through the third exit sub-surface, and is projected onto the bright area in sequence.

2. The optical element according to claim 1, wherein the second reflective sub-surface also has a step laterally extending from the side adjacent to the light entrance surface to the side adjacent to the light exit surface, and light from the step of the second reflective sub-surface also forms the inclined portion of the cut-off line.

3. The optical element according to claim 1, wherein the first reflective sub-surface has only one step.

4. The optical element according to claim 1, wherein a distance parallel to the central axis of the optical element from the vertex of the second exit sub-surface to the second entrance sub-surface is shorter than a distance parallel to the central axis from the first exit sub-surface to the second entrance sub-surface, and is shorter than a distance parallel to the central axis from the third exit sub-surface to the second entrance sub-surface.

5. The optical element according to claim 1, wherein the first entrance sub-surface, the second entrance sub-surface, and the third entrance sub-surface are formed by conic curves or freeform curves.

6. The optical element according to claim 1, wherein the first reflective sub-surface and the second reflective sub-surface are formed by conic curves or freeform curves.

7. The optical element according to claim 1, wherein the first exit sub-surface and the third exit sub-surface are plane surfaces or curved surfaces.

8. A car lamp comprising:

a light source capable of emitting light;

a lens disposed on the path of the light from the light source; and an optical element disposed on the path of the light from the light source and between the light source and the lens, the optical element comprising:

a light entrance surface having a first entrance sub-surface, a second entrance sub-surface, and a third entrance sub-surface which form a cavity for containing the light source, wherein the second entrance sub-surface connects the first entrance sub-surface with the third entrance sub-surface;

a light exit surface opposite to the light entrance surface and having a first exit sub-surface, a second exit sub-surface, and a third exit sub-surface, wherein the second exit sub-surface is connected between the first exit sub-surface and the third exit sub-surface, and wherein the second exit sub-surface is a curved surface and a vertex of the second exit sub-surface is off-center from a central axis of the optical element; and a reflective surface connecting the light entrance surface with the light exit surface, the reflective surface having a first reflective sub-surface connecting the first entrance sub-surface with the first exit sub-surface and a second reflective sub-surface connecting the third entrance sub-surface with the third exit sub-surface, wherein the first reflective sub-surface has a step laterally extending from a side adjacent to the light entrance surface to another side adjacent to the light exit surface;

wherein a first portion of the light from the light source passes through the first entrance sub-surface, is reflected by the first reflective sub-surface, passes through the first exit sub-surface, and is projected onto a reference plane 25 meters away from the optical element by the lens in sequence so as to form a cut-off line on the reference plane, the cut-off line is a boundary between a bright area and a dark area, and light from the step forms an inclined portion of the cut-off line;

wherein a second portion of the light from the light source passes through the second entrance sub-surface and the second exit sub-surface in sequence and is projected onto the bright area by the lens; and wherein a third portion of the light from the light source passes through the third entrance sub-surface, is reflected by the second reflective sub-surface, passes through the third exit sub-surface, and is projected onto the bright area by the lens in sequence.

9. The car lamp according to claim 8, wherein the second reflective sub-surface also has a step laterally extending from the side adjacent to the light entrance surface to the side adjacent to the light exit surface, and light from the step of the second reflective sub-surface also forms the inclined portion of the cut-off line.

10. The car lamp according to claim 8, wherein the first reflective sub-surface has only one step.

11. The car lamp according to claim 8, wherein a distance parallel to the central axis of the optical element from the vertex of the second exit sub-surface to the second entrance sub-surface is shorter than a distance parallel to the central axis from the first exit sub-surface to the second entrance sub-surface, and is shorter than a distance parallel to the central axis from the third exit sub-surface to the second entrance sub-surface.

12. The car lamp according to claim 8, wherein the first entrance sub-surface, the second entrance sub-surface, and the third entrance sub-surface are formed by conic curves or freeform curves.

13. The car lamp according to claim 8, wherein the first reflective sub-surface and the second reflective sub-surface are formed by conic curves or freeform curves.

14. The car lamp according to claim 8, wherein the first exit sub-surface and the third exit sub-surface are plane surfaces or curved surfaces.

15. The car lamp according to claim 8, wherein the light source comprises at least one light-emitting diode.

* * * * *